US007347068B2

(12) United States Patent
Seidel

(10) Patent No.: US 7,347,068 B2
(45) Date of Patent: Mar. 25, 2008

(54) ANTI-THEFT DEVICE

(76) Inventor: Stuart Seidel, 512 NW. 77th St., Boca Raton, FL (US) 33487

( * ) Notice: Subject to any disclaimer, the term of this patent is extended or adjusted under 35 U.S.C. 154(b) by 0 days.

(21) Appl. No.: 10/708,484

(22) Filed: Mar. 5, 2004

(65) Prior Publication Data

US 2004/0172989 A1 Sep. 9, 2004

Related U.S. Application Data

(60) Provisional application No. 60/452,781, filed on Mar. 6, 2003, provisional application No. 60/453,652, filed on Mar. 11, 2003.

(51) Int. Cl.
*E05B 65/00* (2006.01)

(52) U.S. Cl. ..... 70/57.1; 206/1.5; 340/572.1; 340/572.9

(58) Field of Classification Search ..... 70/57.1, 70/423, 424, 427, 428, 453–455; 206/1.5, 206/308.1, 308.2, 387.11; 340/568.1, 572.1, 340/572.9, 572.8

See application file for complete search history.

(56) References Cited

U.S. PATENT DOCUMENTS 3,995,900 A * 12/1976 Humble et al. ..... 70/57.1
4,745,664 A * 5/1988 Damvig ..... 24/704.1
5,426,419 A * 6/1995 Nguyen et al. ..... 340/572.9
5,467,624 A * 11/1995 Myers ..... 70/455
5,791,079 A * 8/1998 Mazzucchelli ..... 40/625
5,946,957 A * 9/1999 Yamamoto et al. ..... 70/423
6,373,390 B1 * 4/2002 Hogan et al. ..... 340/572.8
6,474,117 B2 * 11/2002 Okuno ..... 70/57.1
6,535,130 B2 * 3/2003 Nguyen et al. ..... 340/572.9
2003/0222760 A1 * 12/2003 Sayegh et al. ..... 340/572.9

* cited by examiner

*Primary Examiner*—Suzanne Dino Barrett
(74) *Attorney, Agent, or Firm*—John C. Smith

(57) ABSTRACT

An anti-theft tag that uses single or dual detacher arms. A first detacher arm moves a locking arm aside such that a release arm can rotate to separate the arms of a C-clip that secures the pin on the securing member. Either the first detacher arm, or an alternative second detacher arm then presses the release arm to rotate it. When the release arm is rotated, a wedge on the release arm exerts pressure against the arms of the C-clip to force them apart which causes the securing member pin to be released. The securing member pin cannot be released by the anti-theft tag unless the detacher arms are inserted in sequence. An alternative anti-theft tag provides spring loaded door button at the entrance to the detacher arm chamber. The door button guides an unauthorized tag pick away from the entrance to the detacher arm chamber and routes it toward a dead-end. The detacher arm will press a spring loaded door button to an open position and allow access of the detacher arm into the detacher arm chamber. Once inside the chamber, the detacher arm will press open the sliding clip which secures the anti-theft tag to its securing member.

14 Claims, 18 Drawing Sheets

ANTI-THEFT DEVICE

CROSS REFERENCE TO RELATED APPLICATIONS

This application is a non-provisional application which claims the benefit of the commonly owned copending provisional application entitled "Anti-theft Device," filed Mar. 6, 2003, bearing U.S. Ser. No. 60/452,781 and naming Stuart Seidel, the named inventor herein, as sole inventor, and the commonly owned copending provisional application entitled "Anti-theft Device," filed Mar. 11, 2003, bearing U.S. Ser. No. 60/453,652 and naming Stuart Seidel, the named inventor herein, as sole inventor, the contents of both applications are specifically incorporated by reference herein in their entirety.

BACKGROUND OF INVENTION

1. Technical Field

The present invention relates to anti-theft devices which attach to commodities for preventing theft of the commodity. In particular, it relates to removable anti-theft devices having a tag which triggers an alarm when it is removed from a monitored area, and a removable securing member for attaching the tag to the commodity. Further, it relates to an improved method of preventing unauthorized detachment of the securing member from the tag.

2. Background

Theft of all kinds has been an ongoing problem for virtually all retail establishments. One kind of theft: shoplifting, has caused substantial damage to retailers due to its widespread nature. In an attempt to address this problem, a variety of devices have been developed to limit shoplifting losses by automatically alerting the retailer when an item of merchandise is being illegally removed from the premises.

One type of anti-theft device is the anti-theft tag. An anti-theft tag is typically based on a small device which can be secured to an item. The anti-theft tag typically includes a tuned circuit or antenna device which communicates with detectors placed at the entrances to the retailer's premises. When the detector senses a tag being removed from the store, it alerts the retailer via an alarm that is controlled by the detector.

Anti-theft tags of this type typically contain a first part which holds the tuned circuit or antenna circuitry, along with mechanical methods of securing the first part to a second part which is a securing means. A securing means would typically be a cap-like structure with a securing pin. The securing pin would be pushed through an item, such as a garment, and then secured to the first part. Once a customer has made a purchase, the employee would remove the anti-theft tag so that the customer can take the item out of the store without setting off an alarm.

The mechanical means to remove the securing means from the anti-theft tag was originally a probe which would be inserted into the anti-theft tag and apply pressure to the securing means to force it to release the pin. Unfortunately, shoplifters quickly developed mechanical devices to insert into the anti-theft tag and allow it to be removed from the inventory item. In response, the anti-theft industry has developed a variety of devices designed to defeat the attempts of shoplifters to remove anti-theft tags.

While the prior art has provided numerous types of anti-theft tags, shoplifters remain able to frequently disable these devices by removing them. It would be desirable to have a method of preventing removal of an anti-theft tag with commonly available devices, such as the wires and prongs used by many shoplifters.

SUMMARY OF INVENTION

The present invention solves the foregoing problems by providing a spring loaded door button at the entrance to the detacher arm chamber. The door button guides an unauthorized tag pick away from the entrance to the detacher arm chamber and routes it toward a dead-end. The detacher arm will press a spring loaded door button to an open position and allow access of the detacher arm into the detacher arm chamber. Once inside the chamber, the detacher arm will press open the sliding clip which secures the anti-theft tag to its securing member.

An alternative anti-theft tag uses dual detacher arms. A first detacher arm moves a locking arm aside such that a release arm can rotate to separate the arms of a C-clip that secures the pin on the securing member. A second detacher arm then presses the release arm to rotate it. When the release arm is rotated, a wedge on the release arm exerts pressure against the arms of the C-clip to force them apart and this causes the securing member pin to be released. The securing member cannot be released by the anti-theft tag unless the detacher arms are inserted in sequence.

DETAILED DESCRIPTION

Figure 1:
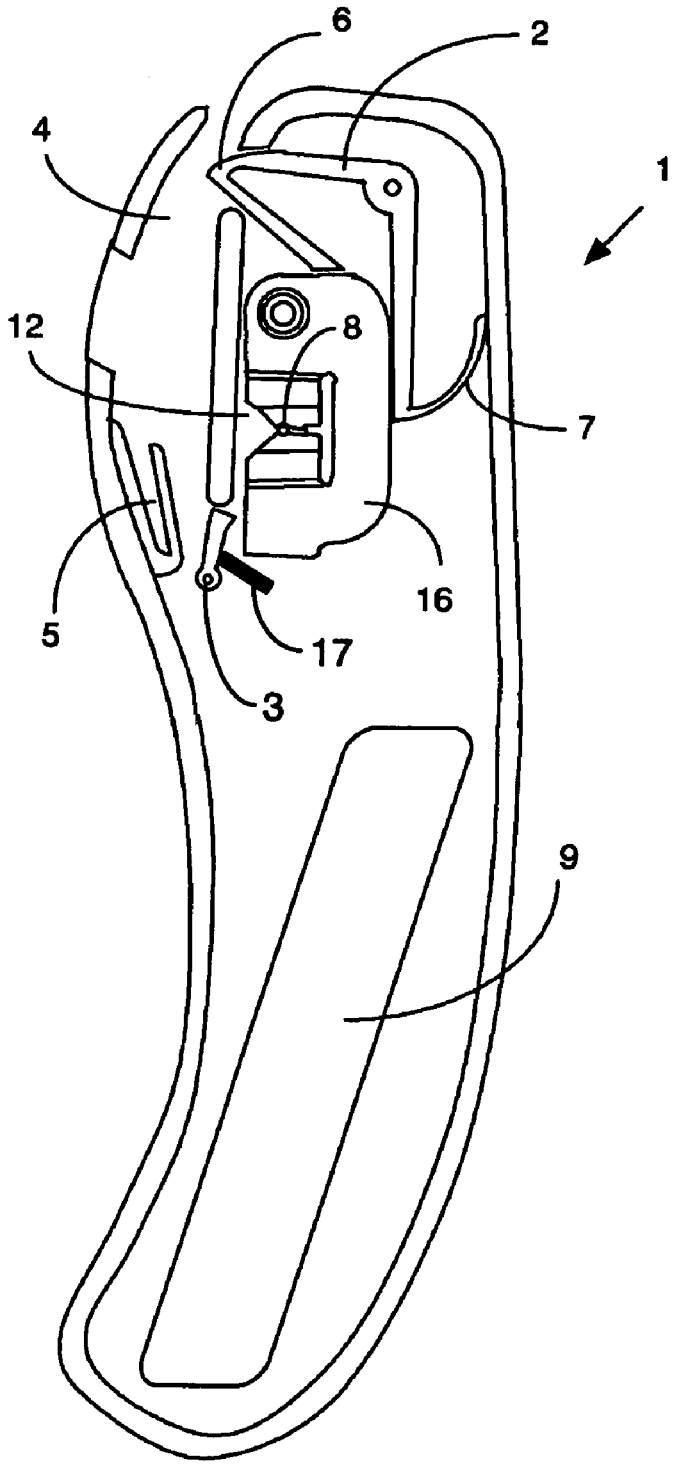
FIG. 1 is a top view of a preferred embodiment of the interior of an anti-theft tag which illustrates the detacher arm chamber, the sliding clip, the spring loaded door button, the dead-end used to divert picks, the identification tag, and the pin from the securing member.

Prior to a detailed discussion of the figures, a general overview of the system will be presented. For purposes of this disclosure, the term "pick" will be used to refer to any device used by an unauthorized person to attempt to release the antitheft tag from its securing member.

This invention provides several embodiments that are improvements over the prior art, and commercially available, anti-theft tags which have been the subject of a variety of attacks by thieves. In fact, many shoplifters have found ways to defeat currently available anti-theft tags. One embodiment of the current invention uses a new clip lock, open shelf and door button which make it more difficult to overcome the securing mechanism of an anti-theft tag, by providing an improved method of directing picks away from the access door to the detacher arm chamber, and toward a dead-end. A further advantage of the invention is that it is capable of being opened using the same commercially available detachers that are currently used to detach tags of this type, or alternatively, opened by a novel single or dual straight detacher arm. As a result, the anti-theft tag of the present invention can be opened by a variety of attachment devices.

This invention also provides the ability to open an anti-theft tag using a single armed tag detacher, or alternatively, a tag detacher that uses dual arms operating in conjunction with one another. Further, the device can work with conventional curved detector arms or single or dual straight arms.

In a preferred embodiment, the invention provides two spring loaded mechanisms which are designed to direct a pick in the wrong direction. The first spring loaded mechanism is a clip lock which simultaneously provides pressure to secure the sliding clip against the pin of a securing member, and also protrudes into the detacher arm entry area of the anti-theft tag to direct the pick in the wrong direction. In the preferred embodiment, the detacher arm has sufficient rigidity to allow it to move the clip lock out of its way and remain on the correct path. On the other hand, a pick will typically be flexible enough such that it will be redirected away from the entrance to the detacher arm chamber.

As the pick proceeds further into the detacher arm entry area, it will arrive at an angle at which it enters a dead-end cavity. As a result, the pick will be unable to detach the securing member from the anti-theft tag. Because the detacher arm is rigid and is not diverted away from its correct path, it will not enter the dead-end cavity.

Another embodiment of the invention uses a C-clip that requires two picks to release the securing member. A wedge arm has a tab that rotates two separate the arms of the C-clip to release the securing member. A spring loaded locking arm prevents rotation of the wedge arm unless it is moved out of the path of the wedge arm. A first pick moves the spring loaded locking arm out of the path of rotation of the wedge arm, and a second pick presses against the end of the wedge arm to rotate it. The wedge arm has a tab that fits between the arms of the C-clip. When the wedge arm is rotates, the tab separates the arms of the c-clip to release the securing member. Having discussed the features and advantages of the invention in general, we turn now to a more detailed discussion of the figures.

FIG. 1 is a top open view of a preferred embodiment of the anti-theft tag 1. This figure illustrates the detacher arm entry area 4 which provides the entry path for the detacher arm 10 (shown below in FIGS. 2 and 3). When the detacher arm 10 is inserted into the detacher arm entry area 4, it first passes by the distal end 6 of the clip lock 2. The distal end 6 of the clip lock 2 protrudes into the detacher arm entry area 4. Due to its rigidity, the detacher arm 10 compresses the clip lock 2 which does not interfere with its passage into the detacher arm entry area 4.

However, because a shoplifter's pick 11 is typically a crude instrument, it will usually be misdirected upon entry to the detacher arm entry area 4. When a pick 11 (shown below in regard to FIG. 4) is inserted into the detacher arm entry area 4, the proximal end 6 of the clip lock 2 directs the pick 11 away from the path leading to the door button 3 and toward the dead-end cavity 5. Once the pick enters the dead-end cavity 5, it cannot release the pin 8 of the securing member from the anti-theft tag 1. As a result, the shoplifter's attempt to remove the anti-theft tag 1 is defeated.

Also shown in this figure is a door button 3 which is opened by a legitimate detacher arm 10. Once the door button 3 is opened, the detacher arm 10 enters the detacher arm chamber 12 and then presses against the sliding clip 16 which causes it to release the securing member pin 8. Once this happens, the securing member pin 8 can be released and the anti-theft tag 1 can be removed from the item it is attached to.

When the detacher arm 10 is removed from the anti-theft tag 1, the clip lock return spring 7 returns the sliding clip 16 to its locked position. In addition, door button 3 is also returned to its closed position via a spring. Also shown in this figure is ID tag 9. ID tags 9 are commercially available and well-known in the art.

Figure 2:
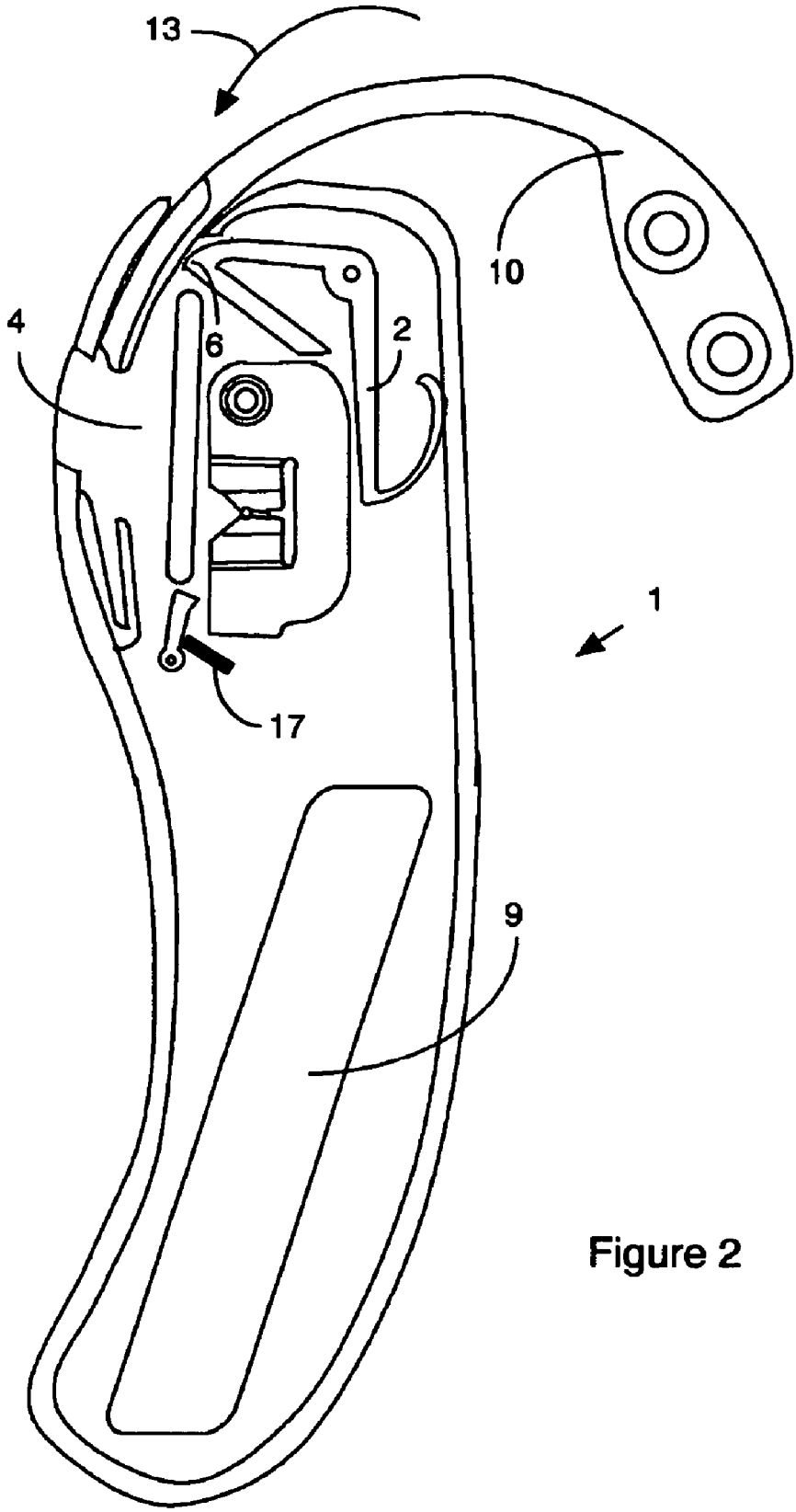
FIG. 2 is a top view of the preferred embodiment of FIG. 1 which illustrates the detacher arm being partially inserted into the detacher arm chamber.

Regarding FIG. 2, the detacher arm entry area 4 protects clip lock 2 which is pushed down by the detacher arm 10, and which in turn unlocks the sliding clip 16. This figure illustrates a detacher arm 10 being inserted into the detacher arm entry area 4 along path 13. Because the detacher arm 10 is sufficiently rigid, it presses the distal end 6 of the clip lock 2 into the detacher arm chamber 12. Likewise, due to the rigidity of the detacher arm 10, it is not diverted from the proper path.

The lower portion of the detacher arm entry area 4 protects door button 3 which is used to protect and disguise the opening to the detacher arm chamber 12, where sliding clip 16 rests, from the shoplifter trying to open the anti-theft tag 1. While the door button 3 conceals the opening to the detacher arm chamber 12, it is easily pushed open by the detacher arm 10. This allows the detacher arm 10 to enter the detacher arm chamber 12, and to push open the sliding clip 16. Likewise, when the detacher arm 10 is removed, the door button 3 returns to the closed position via a spring.

Figure 3A:
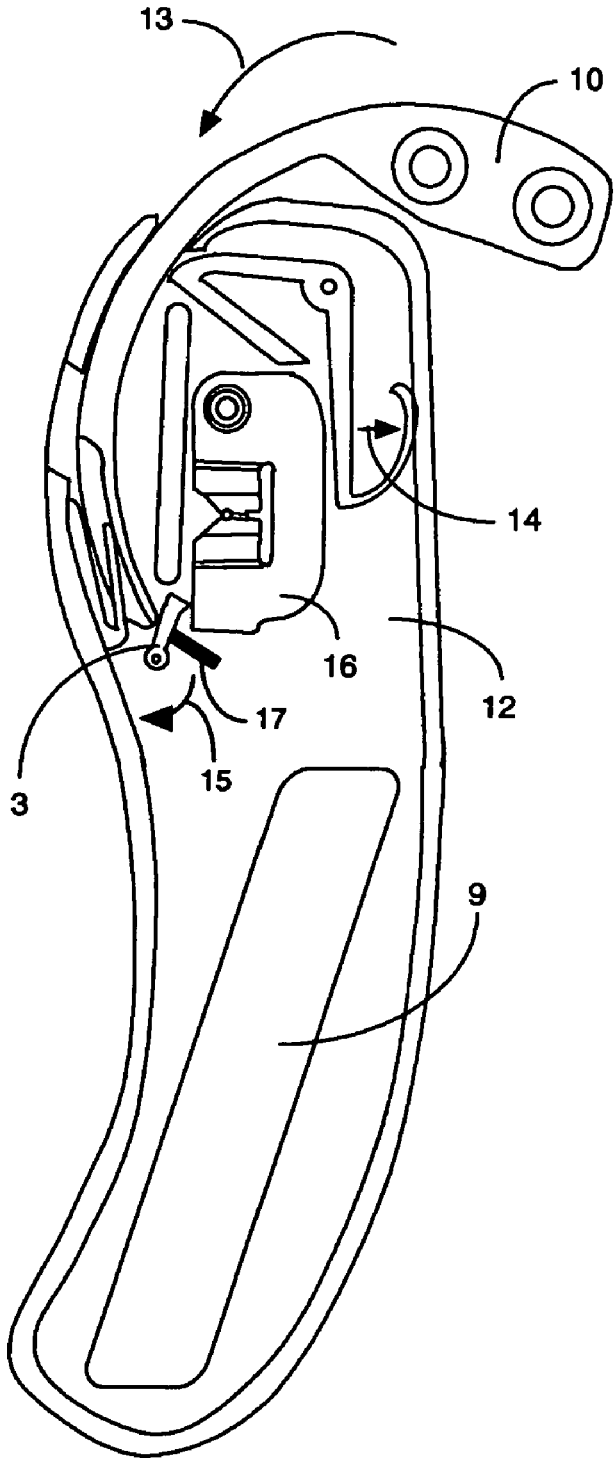
FIG. 3A is a top view of the preferred embodiment of FIG. 1 which illustrates prior art detacher arm being inserted into the detacher arm chamber, and pushing the spring loaded door button to an open position to allow the detacher arm to engage the sliding clip.

FIG. 3A shows the detacher arm 10 pushing against the spring loaded door button 3. As the spring loaded door button 3 rotates in direction 15 under pressure from detacher arm 10, it will rotate sufficiently out of the way to allow entry of the detacher arm 10 into the detacher arm chamber 12. Once the detacher arm 10 enters the detacher arm chamber 12 it will press against the end of sliding clip 16 which will then flex to release securing member pin 8.

As sliding clip 16 is opened by detacher arm 10, it presses against clip lock 2, in direction 14, and compresses clip lock return spring 7. Once the detacher arm 10 is removed, the clip lock return spring 7 will return the sliding clip 16 to its proper position.

In summary, the sliding clip 16 is pressed by the detacher arm 10 and forces the sliding clip 16 to rotate so that the securing member pin 8 exerts pressure to bend open, or squeeze out, through the arms of the sliding clip 16 so as to release the securing member pin 8. The sliding clip 16 is bent open as a result of pushing against the securing member pin 8, which is a passive force, while the sliding clip 16 is bent open as a direct result of being pushed by the detacher arm 10. The sliding clip 16 is returned into place by clip lock 2 as a result of pressure from the clip lock return spring 7 once the detacher arm 10 is removed. Variations of sliding clip 16 are commonly used an anti-theft tags to releasably secure pin 8. This type of clip is well-known in the art, and is exemplified in U.S. Pat. No. 3,995,900.

Figure 3B:
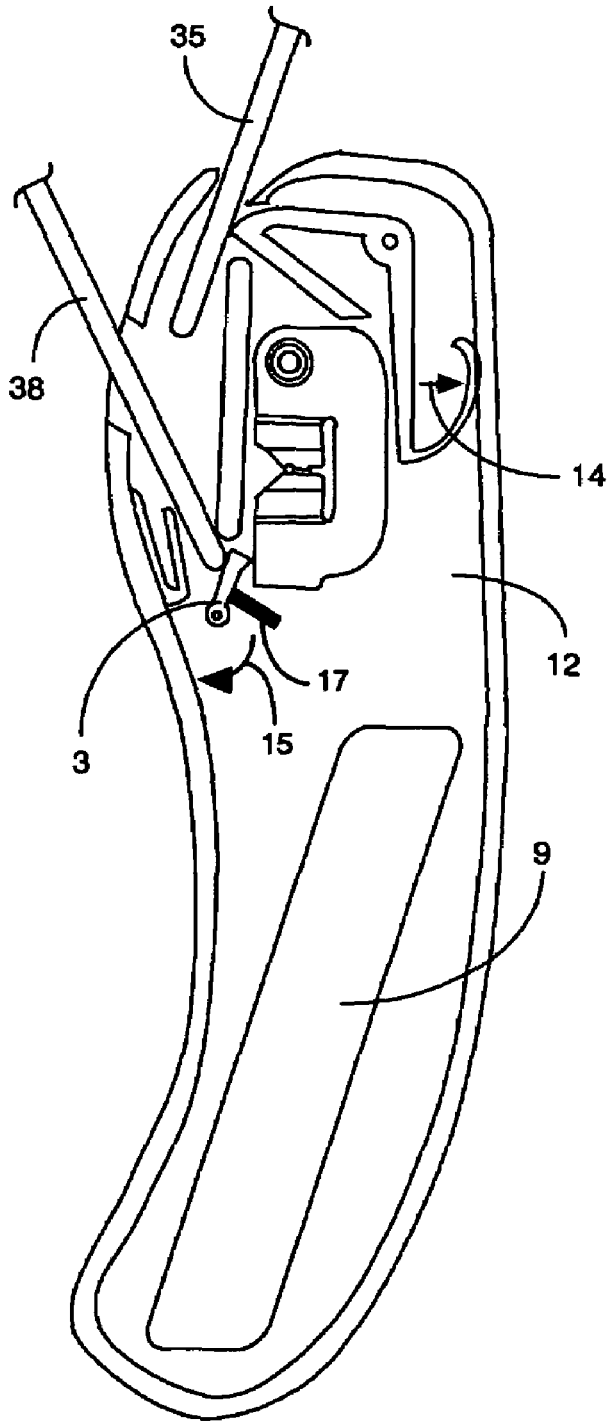
FIG. 3B is a top view of the preferred embodiment of FIG. 1 which illustrates dual straight detacher arms being inserted into the detacher arm chamber, and pushing the spring loaded door button to an open position to allow the detacher arm to engage the sliding clip.

FIG. 3B is a top view of the preferred embodiment of FIG. 1 which illustrates dual straight detacher arms being inserted into the detacher arm chamber. In this embodiment, detacher arm 38 can be configured to push the spring loaded door button to an open position to allow the detacher arm to engage the sliding clip 16, or alternatively, it can press or button 3 into sliding clip 16 such that your button 3 opens sliding clip 16 to release pin 8.

Figure 4:
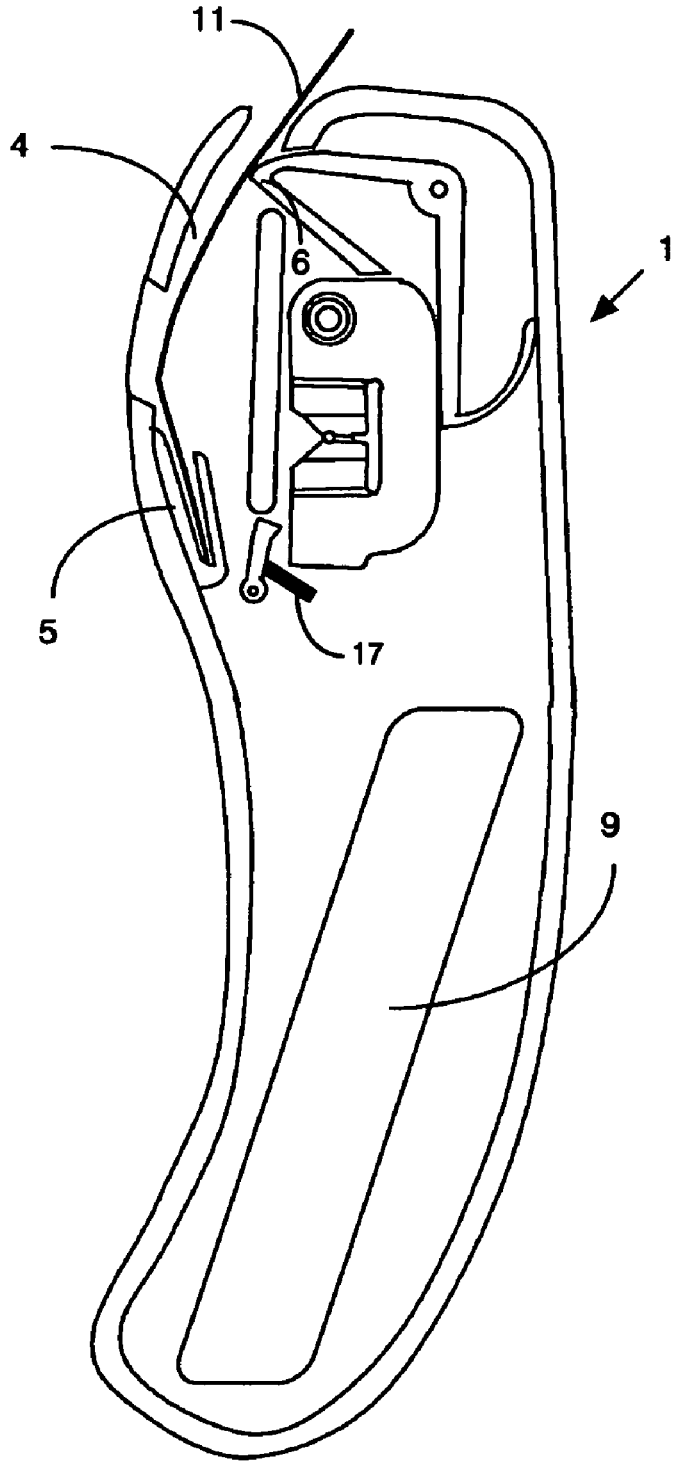
FIG. 4 is a top view of a preferred embodiment of the interior of an anti-theft tag which illustrates a pick being inserted into the input area of the detacher arm chamber. This figure illustrates the pick being routed into the dead-end chamber.

FIG. 4 illustrates how the invention acts to defeat a pick 11. The dead-end cavity 5 in the anti-theft tag 1 provides no access to the sliding clip 16. In addition, it also acts to confuse a shoplifter who is attempting to remove the anti-theft tag 1. As can be seen from this figure, when the pick 11 is inserted into the detacher arm entry area 4, it is diverted by the distal end 6 of clip lock 2 such that it moves away from a path that would lead into the door button 3. Instead, it travels along a path that leads it to the dead-end cavity 5. As a result, the shoplifter will not be able to open the anti-theft tag 1 with a conventional pick. Further, due to the multiple obstacles placed in the path of anything entering the detacher arm entry area 4, only a detacher arm 10 which has the correct shape, curvature, and rigidity can release the securing member pin 8 from the anti-theft tag 1.

Figure 5:
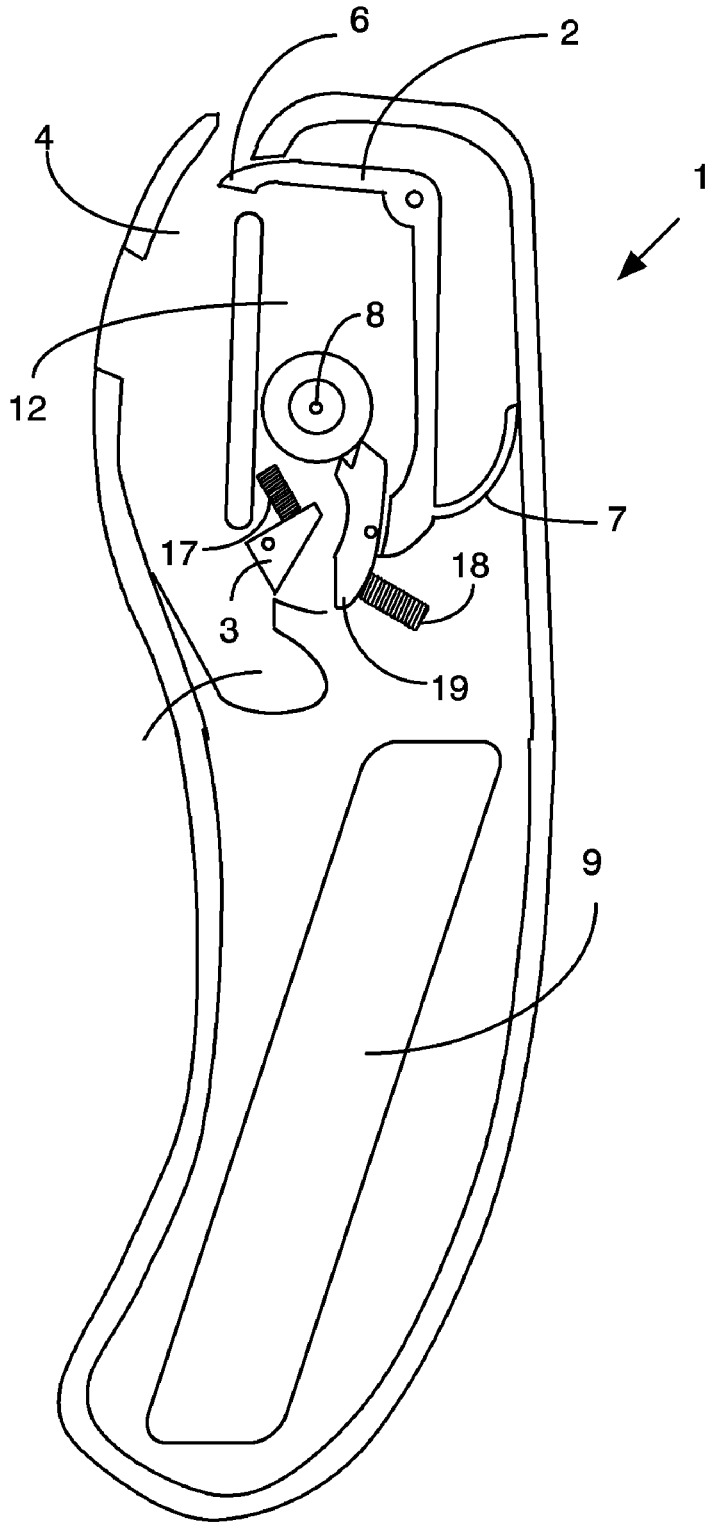
FIG. 5 is a top view of an alternative embodiment of the interior of an antitheft tag. This embodiment illustrates an alternative gate mechanism and an alternative pin release mechanism.

FIG. 5 is a top view of an alternative embodiment of the interior of an anti-theft tag 1. In this embodiment, door button 3 is held in the closed position by spring 17 when the anti-theft tag 1 is attached to an item of merchandise. When the closed position, it presents what appears to be merely a portion of the wall which forms detacher arm entry area 4. In the event a pick 11 is inserted into the anti-theft tag 1, it passes by door button 3 and enters the dead-end cavity 5. Alternatively, when the rigid detacher arm 10 is inserted into the detacher arm entry area 4, it will force open door button 3 and compress spring 17. It will then enter the detacher arm chamber 12 where it will press against the end of retaining arm 19 and compress spring 18. When at rest, spring 18 presses against retaining arm 19 and prevents it from engaging securing member 20 (shown below in regard to FIGS. 6A-B). When the detacher arm 10 presses against retaining arm 19, it forces retaining arm 19 to pivot and apply force to the securing member 20. When force is applied to the securing member 20, securing member 20 is then released from the anti-theft tag 1. Once the detacher arm 10 is removed, the retaining arm 19 is moved back into the rest position by spring 18 and clip lock 2.

Figure 6A:
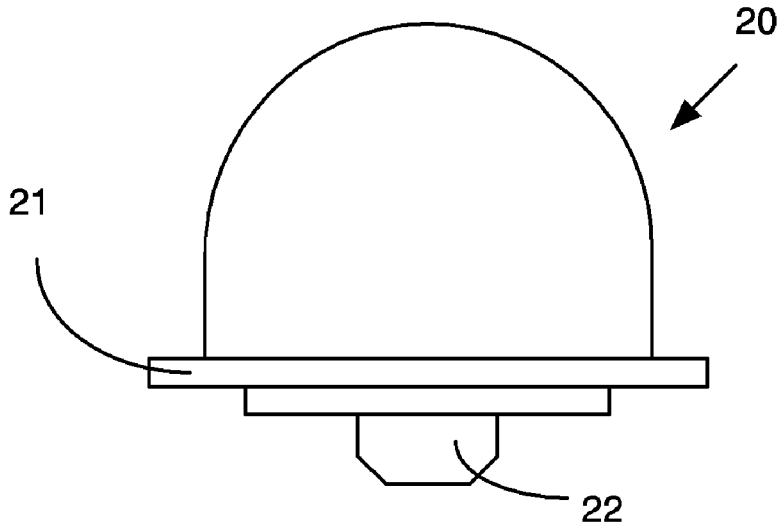
FIG. 6A illustrates a side view of a preferred embodiment of a securing member for use with the anti-theft tag.

FIG. 6A illustrates a side view of a preferred embodiment of a securing member 20 for use with the anti-theft tag 1. In the preferred embodiment, securing member 20 is a conventional spring loaded ball bearing lock. It has a flange 21 which presses against the inventory item and anti-theft tag 1. In addition, it has a spring loaded release mechanism 22 which is moved by the retaining arm 19 under force applied by the detacher arm 10.

Figure 6B:
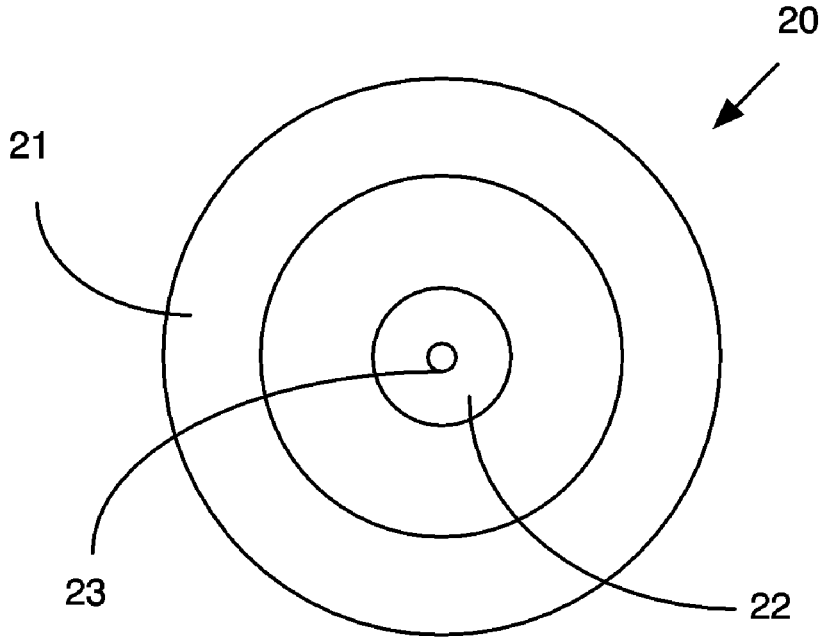
FIG. 6B illustrates a bottom view of a preferred embodiment of a securing member for use with the anti-theft tag.

FIG. 6B illustrates a bottom view of the preferred embodiment of FIG. 6A. This view further illustrates the flange 21, the spring loaded release mechanism 22, and a pin aperture 23. In the preferred embodiment, the pin 8 is secured using a spring-loaded ball clutch release mechanism. Spring-loaded ball clutch release mechanisms are well known in the art.

Figure 7:
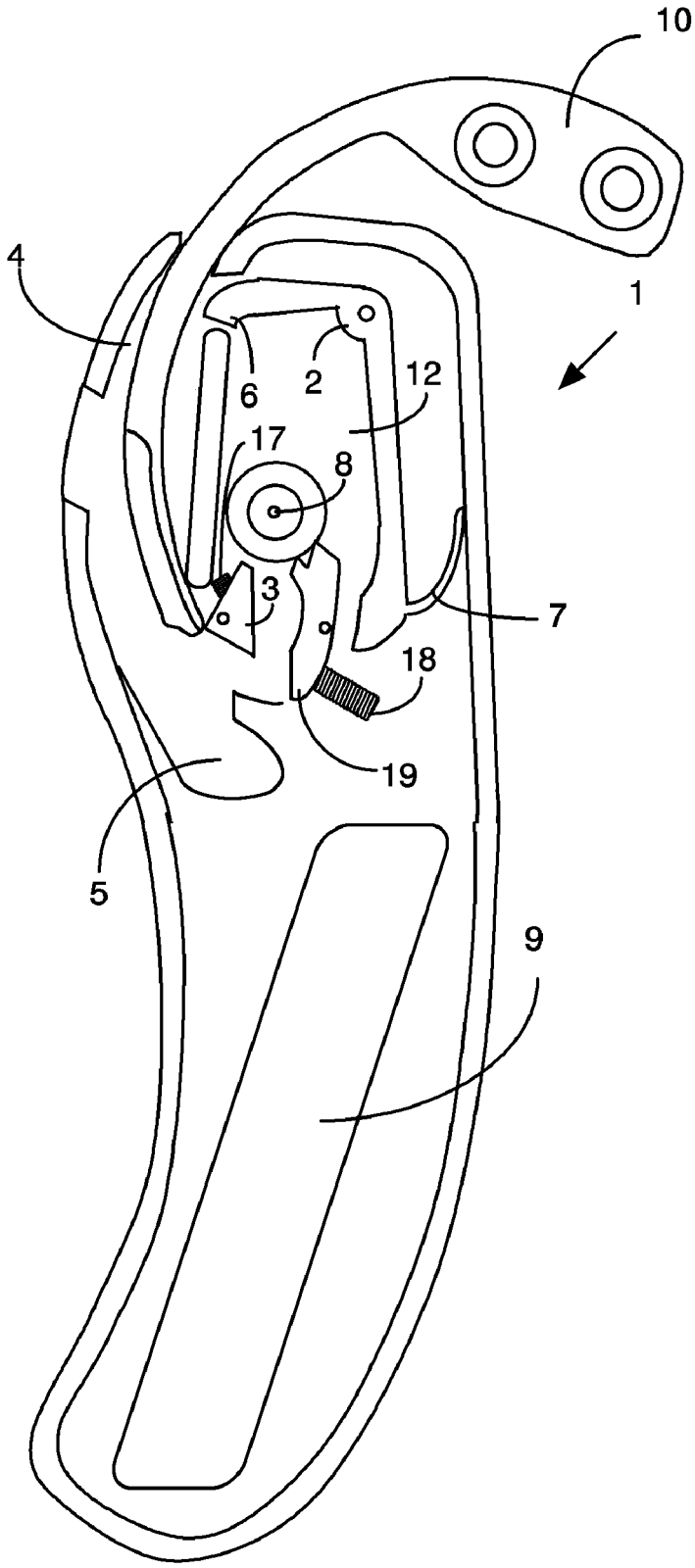
FIG. 7 is a top view of an alternative embodiment of the interior of an anti-theft tag. This embodiment illustrates a detacher arm inserted into the anti-theft tag and forcing the gate mechanism open and releasing the pin release mechanism.

FIG. 7 is a top view the alternative embodiment of anti-theft tag 1 as exemplified by FIG. 5. This embodiment illustrates a detacher arm 10 inserted into the anti-theft tag 1 and forcing the door button 3 to pivot open and compress spring 17. The end of the detacher arm 10 is shown extending into the detacher arm chamber 12 where it presses against retaining arm 19. Under pressure from the detacher arm 10, the retaining arm 19 compresses spring 18 and applies pressure to the spring loaded pin release mechanism 22. This pressure releases the pin 8 and allows the securing member 20 to be removed.

Figure 8:
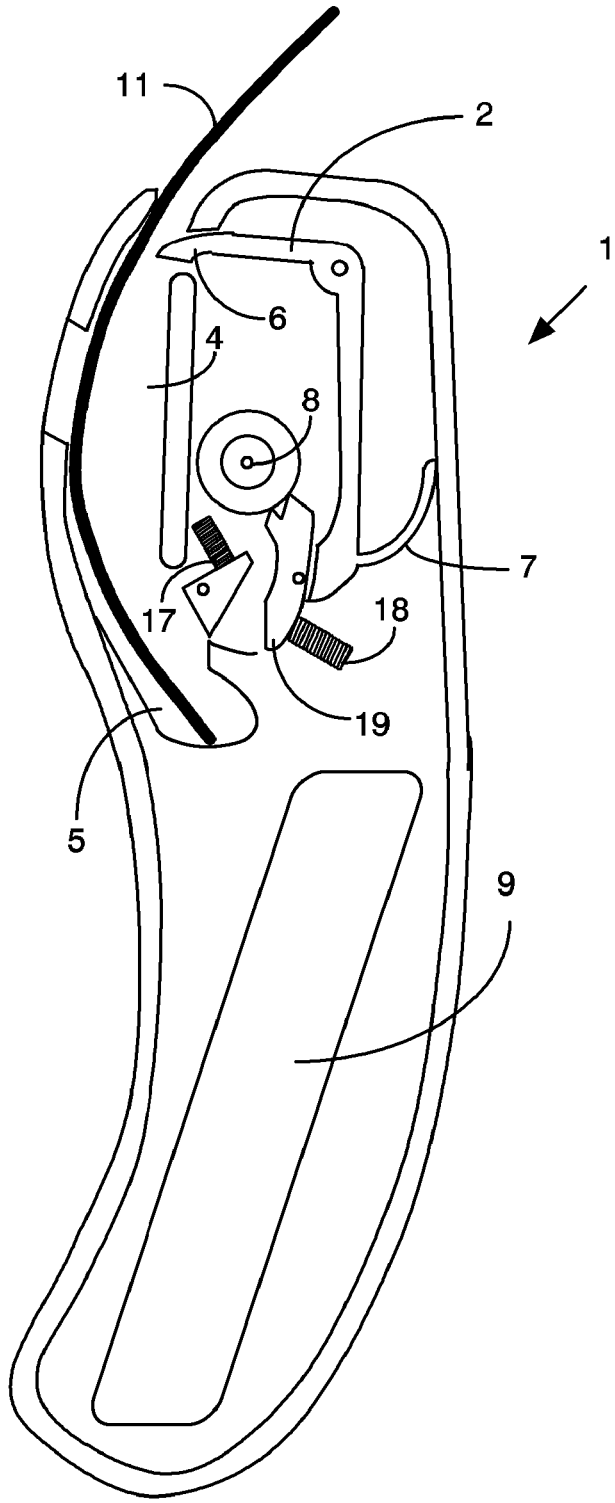
FIG. 8 illustrates a pick being misdirected after insertion into the anti-theft tag.

FIG. 8 illustrates a pick 11 being misdirected after insertion into the anti-theft tag 1. As was the case with the previous embodiment, the pick 11 is prevented from entering the detacher arm chamber 12 by door button 3. Instead, it is miss-routed into dead-end cavity 5. As a result, the thief is unable to disengage the securing member 20 from the anti-theft tag 1.

Figure 9A:
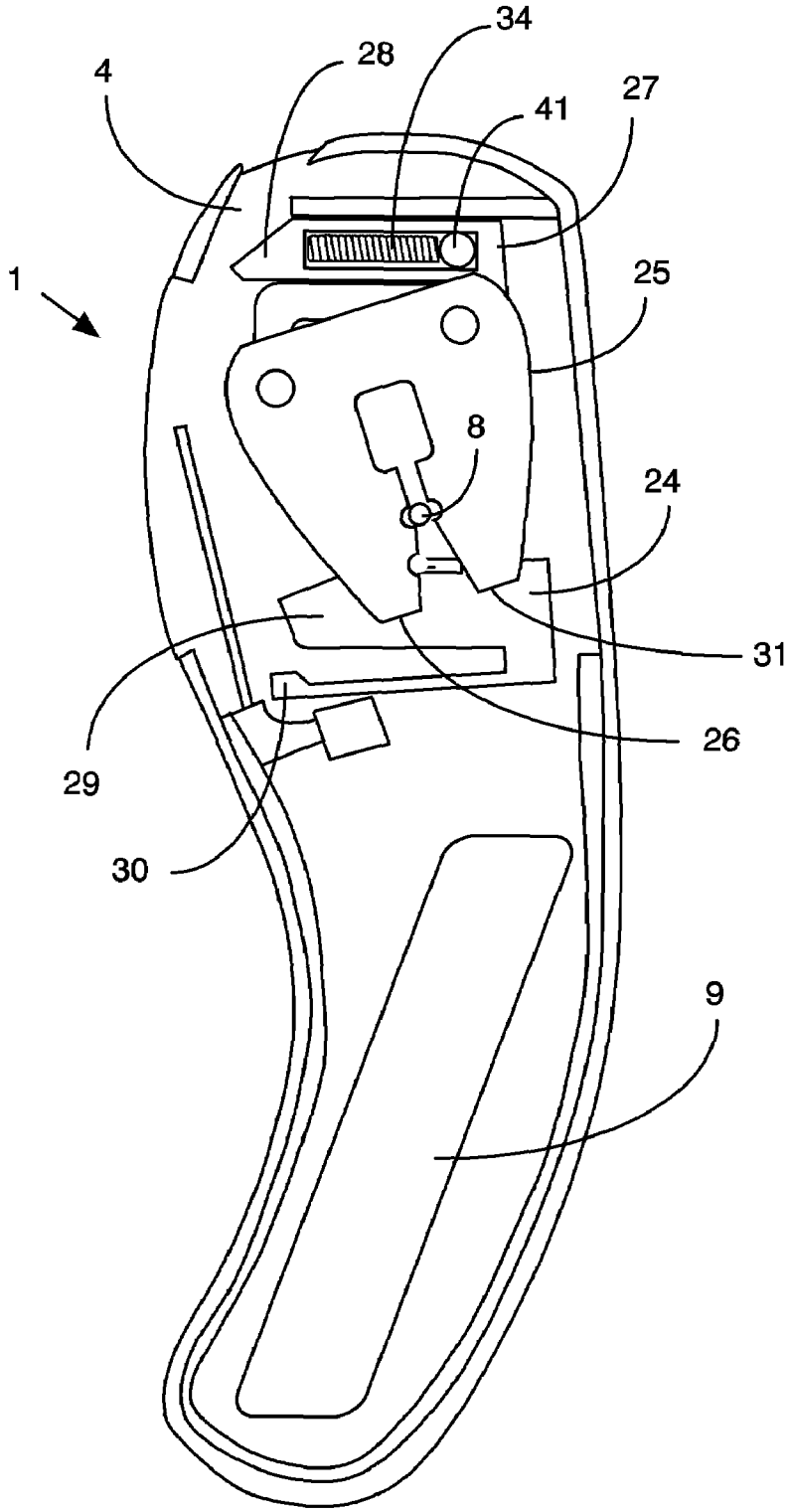
FIG. 9A illustrates an interior view of an alternative embodiment of the anti-theft tag. This view illustrates the C-clip in the locked position, the release arm at rest, and the locking arm in the locked position. The locking arm also shows an interior spring that automatically retracts the locking arm to the locking position when the first detacher arm is not present.

FIG. 9A illustrates an interior view of an alternative preferred embodiment of the anti-theft tag 1. This view illustrates the C-clip 25 in the locked position. When the C-clip 25 is in the locked position, its arms 31, 26 securely grasp pin 8 of the securing member 20. The release arm 24 is shown in the rest position in which its upper flange 29 and its lower spring arm 30 are separated from one another. In addition, the locking arm 27 is in the locked position. When in the locked position, the tip 28 of the locking arm 27 extends into detacher arm entry area 4. Wedge 33 extends from the upper flange 29 of release arm 24 between the arms 31 and 26 of C-clip 25. When in the locked position, wedge 33 is angled such that does not apply pressure to separate arms 31 and 26 of C-clip 25. The locking arm 27 also shows a spring 34 that automatically retracts the locking arm 27 to the locking position when the first detacher arm is not present. A post 41 holds one end of the interior spring 34 in place when the locking arm 27 is moved laterally by a detacher arm 35 to the unlocked position. When in the unlocked position, the spring 34 is compressed. When the detacher arm 35 is removed, the spring 34 returns the locking arm 27 to the locked position.

Figure 9B:
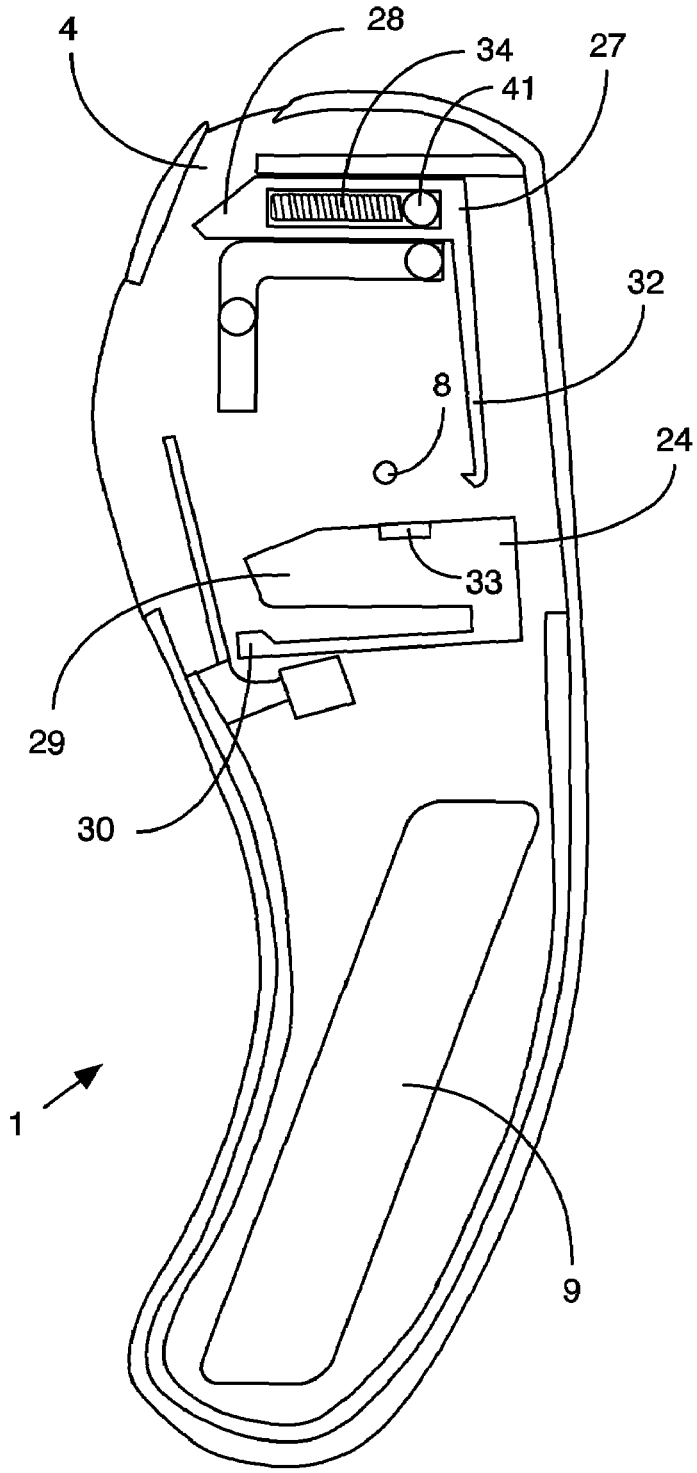
FIG. 9B illustrates an interior view of the alternative embodiment of FIG. 9A. In this view, the C-clip is removed to show the locking arm in a locked position which prevents the release arm from rotating.

FIG. 9B illustrates an interior view of the alternative preferred embodiment of FIG. 9A. In this view, the C-clip 25 is removed to show the locking arm 27 in a locked position which prevents the release arm 24 from rotating. In this figure, tip 28 of locking arm 27 extends into detacher arm entry area 4. Also shown in this figure is extension arm 32 of locking arm 27. Extension arm 32 extends downward to block rotation of release arm 24. By blocking the rotation of release arm 24, wedge 33 is prevented from rotating in relation to the arms 31, 26 of C-clip 25. In turn, this prevents the arms 31 and 26 of C-clip 25 from being moved away from one another by wedge 33 to disengage from pin 8.

Those skilled in the art will recognize that any number of suitable spring arrangements can be implemented to accomplish the function of spring 34. For example, the spring 34 can be attached to locking arm 27 as shown, it can be placed outside of locking arm 27 to exert external pressure, it can be a helical spring as shown, or any other suitable spring mechanism. The only requirement is that the spring chosen is suitable for the purposes of the invention, and can reliably move the locking arm 27 to the locked position when desired.

Figure 10A:
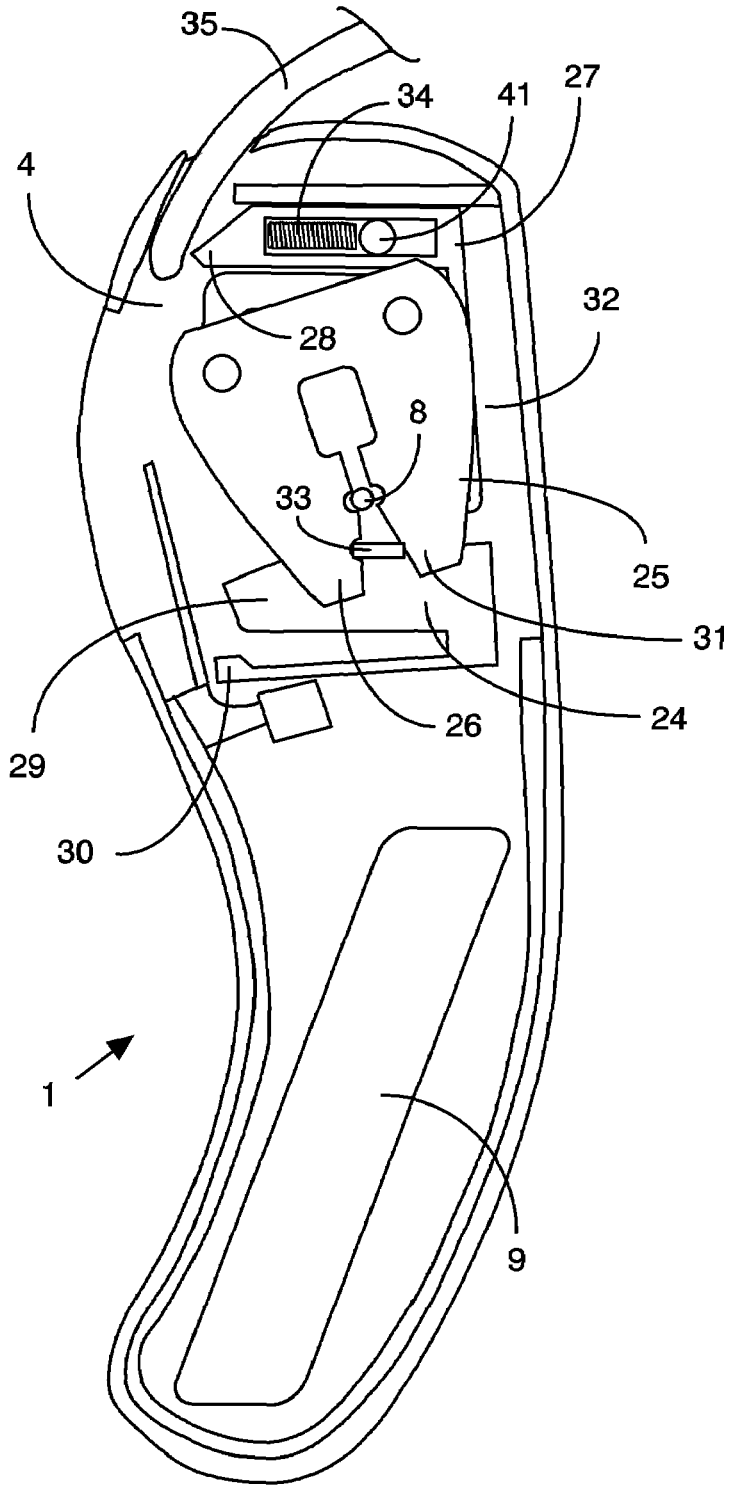
FIG. 10A illustrates an interior view of the alternative embodiment of FIG. 9A in which the first detacher arm is inserted to move the locking arm from the locked to the unlocked position. The detacher arm in this figure is a prior art curved detacher arm.

FIG. 10A illustrates an interior view of the alternative preferred embodiment of FIG. 9A in which the first detacher arm 35 is inserted to move the locking arm 27 from the locked to the unlocked position. In this figure, a prior art curved detacher arm 35 is shown. As can be seen, when the first detacher arm 35 is inserted into detacher arm entry area 4, it presses against the angled end 28 of locking arm 27 and forces it to slide sideways such that extension arm 32 no longer obstructs rotation of release arm 24.

Figure 10B:
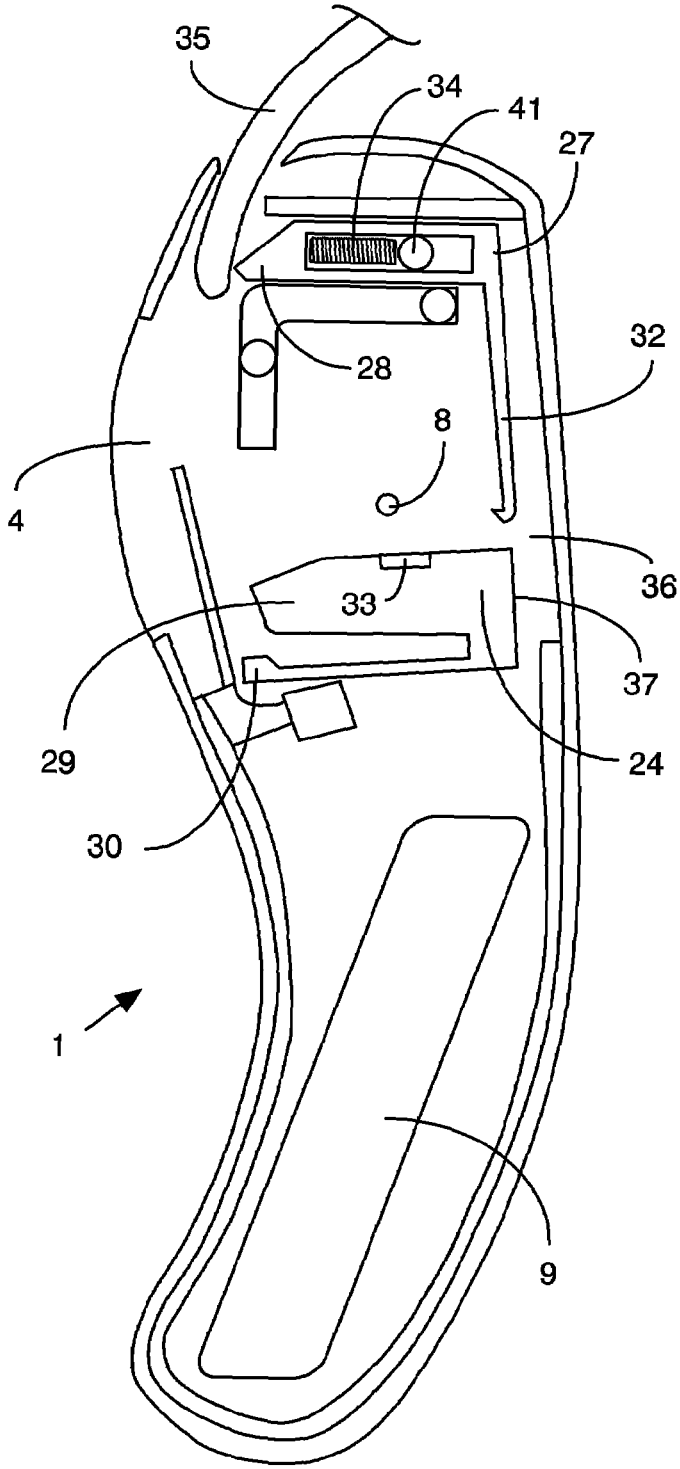
FIG. 10B illustrates an interior view of the alternative embodiment of FIG. 10A. In this view, the C-clip is removed to better observe the relative positions of locking arm and the release arm. A transparent view of the locking arm is shown to illustrate an interior spring extended when the locking arm is moved to the unlocked position when the first detacher arm is inserted.

FIG. 10B illustrates an interior view of the alternative preferred embodiment of FIG. 10A. In this view, the C-clip 25 is removed to better observe the relative positions of locking arm 27 and the release arm 24. A transparent view of the locking arm 27 is shown to illustrate the interior spring 34 in the extended position when the locking arm is moved to the unlocked position when the first detacher arm 35 is inserted.

As can be seen in this figure, when the locking arm 27 is moved to the unlocked position, the tip 36 of extension arm 32 is moved past the end 37 of release arm 24. In this position, locking arm 27 no longer obstructs rotation of release arm 24.

Figure 11:
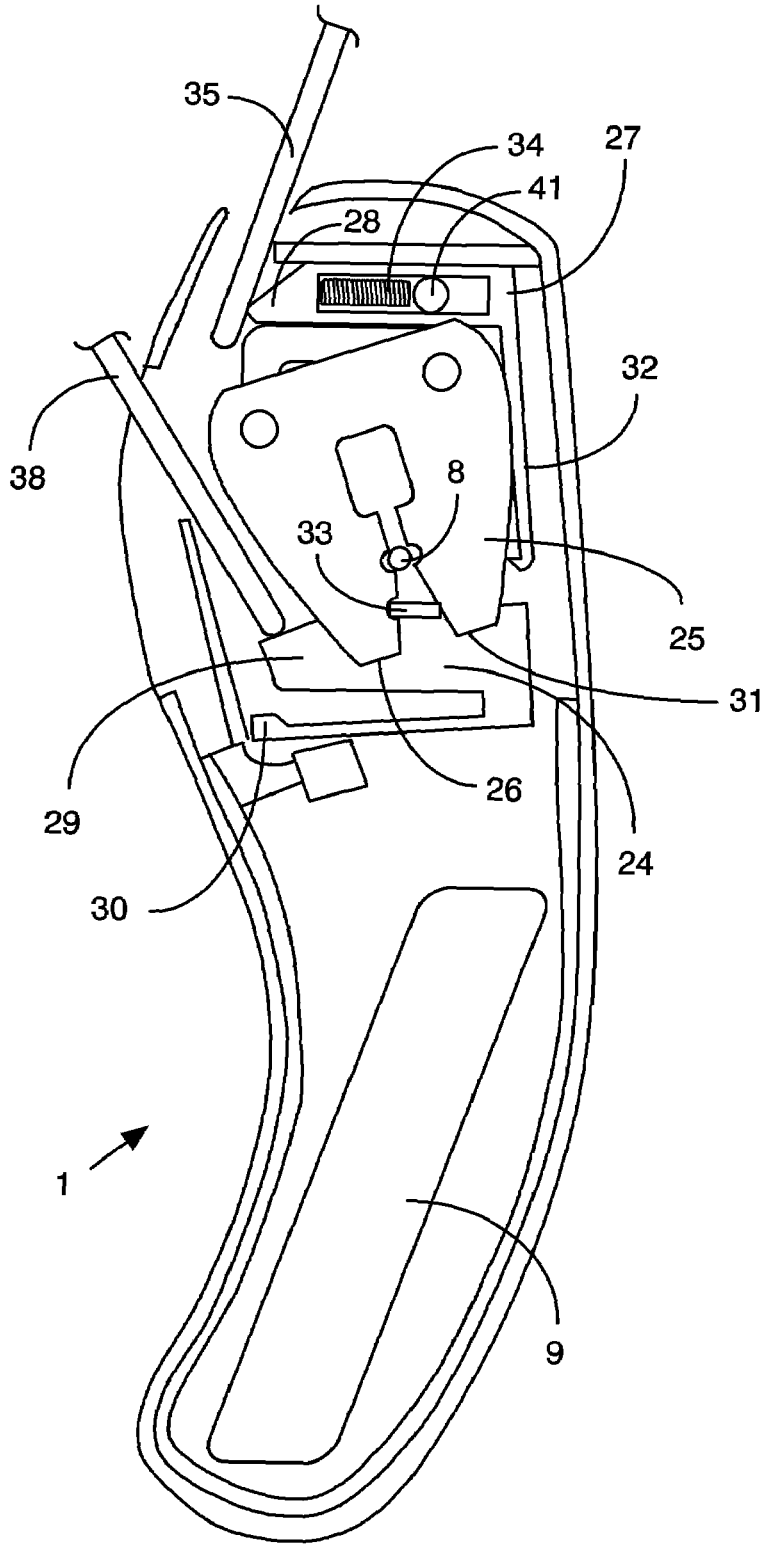
FIG. 11 illustrates an interior view of the alternative embodiment of FIG. 10A. This embodiment uses dual straight detacher arms. In this view, the first detacher arm is inserted to move the locking arm to the unlocked position, and the second detacher arm is inserted into the anti-theft tag. In this view, the second detacher arm is not inserted to the point where the release arm is rotated.

FIG. 11 illustrates an interior view of the alternative preferred embodiment of FIG. 10A. This figure illustrates how the same anti-theft tag 1 can be opened with dual straight detacher arms 35, 38 instead of a conventional curved detacher arm. In this view, the first detacher arm 35 is inserted to move the locking arm 27 to the unlocked position, and the second detacher arm 38 is inserted into the anti-theft tag 1. In this view, the locking arm 27 is moved to the unlocked position, but the second detacher arm 38 is not inserted to the point where the release arm 24 is rotated.

Figure 12A:
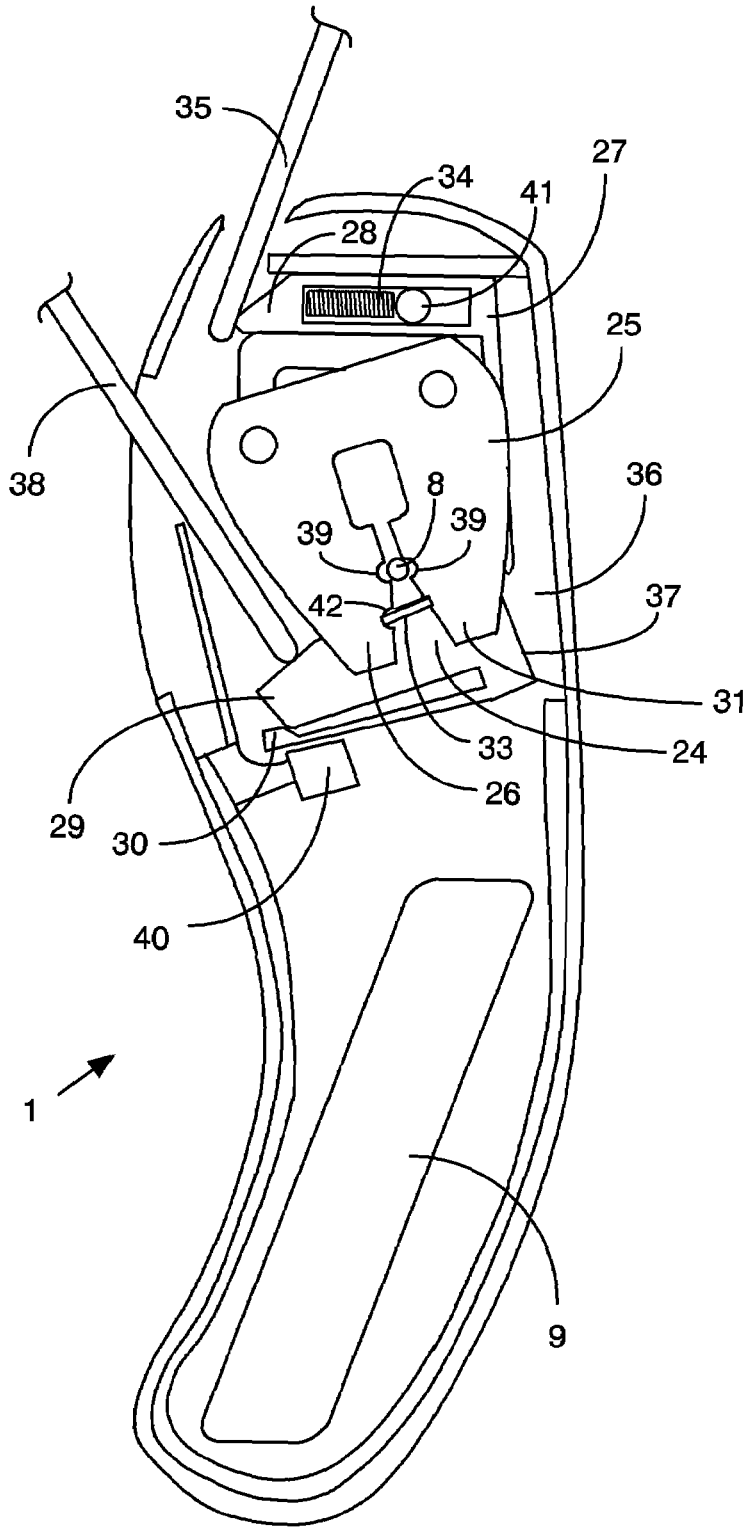
FIG. 12A illustrates an interior view of the alternative embodiment of FIG. 11. In this view, the first detacher arm is inserted to move the locking arm to the unlocked position, and the second detacher arm is inserted into the anti-theft tag far enough to rotate the release arm.

FIG. 12A illustrates an interior view of the alternative preferred embodiment of FIG. 11. In this view, the first detacher arm 35 is inserted to move the locking arm 27 to the unlocked position, and the second detacher arm 38 is inserted into the anti-theft tag 1 far enough to rotate the release arm 24. In the normal rest position (i.e., the locked position), lower spring arm 30 applies pressure to hold upper flange 29 away from it which results in upper flange 29 rotating clockwise. Lower spring arm 30 is prevented from moving by post 40. This rotation allows wedge 33, which extends from flange 29 to rotate such that it provides reduced pressure on the opposing arms 26, 31 of C-clip 25. When this happens, the arms 26, 31 of C-clip 25, together and firmly secure pin 8 of the securing member.

When the second detacher arm 38 is inserted, it presses against upper flange 29 of release arm 24 and causes upper flange 29 to rotate in a counterclockwise direction. This changes the angle at which wedge 33 is in relation to arms 26, 31. As shown this figure, wedge 33 is secured in position on arm 26 by placing it in a notch 42 which prevents it from slipping. As a result, only the portion of wedge 33 which is in contact with arm 31 will move in relation to that arm. As wedge 33 slides upward along the inner edge of arm 31, it forces arms 31 and 26 apart from one another. In turn, pin 8 is released from the grip of notches 39 in arms 31 and 26 which allows pin 8 and its associated securing member 20 to be removed.

Figure 12B:
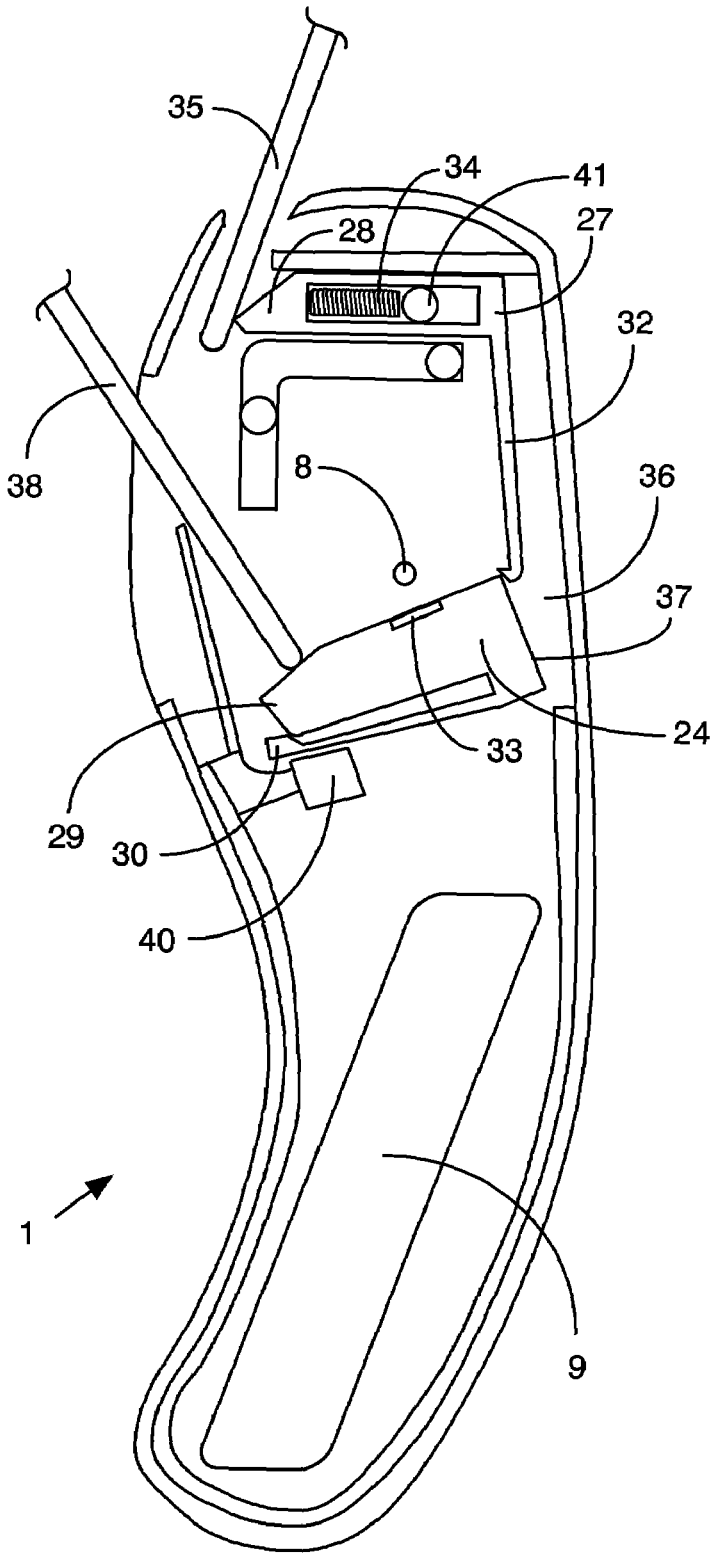
FIG. 12B illustrates an interior view of the alternative embodiment of FIG. 12A. In this view, the first detacher arm is inserted to move the locking arm to the unlocked position, and the second detacher arm is inserted into the anti-theft tag far enough to rotate the release arm. In this figure, the C-clip has been removed to illustrate the relative positions of the locking arm and the release arm.

FIG. 12B illustrates an interior view of the alternative preferred embodiment of FIG. 12A. In this view, the first detacher arm 35 is inserted to move the locking arm 27 to the unlocked position, and the second detacher arm 38 is inserted into the anti-theft tag 1 far enough to rotate the release arm 24. In this figure, the C-clip 25 has been removed to illustrate the relative positions of the locking arm 27 and the release arm 24.

Figure 13:
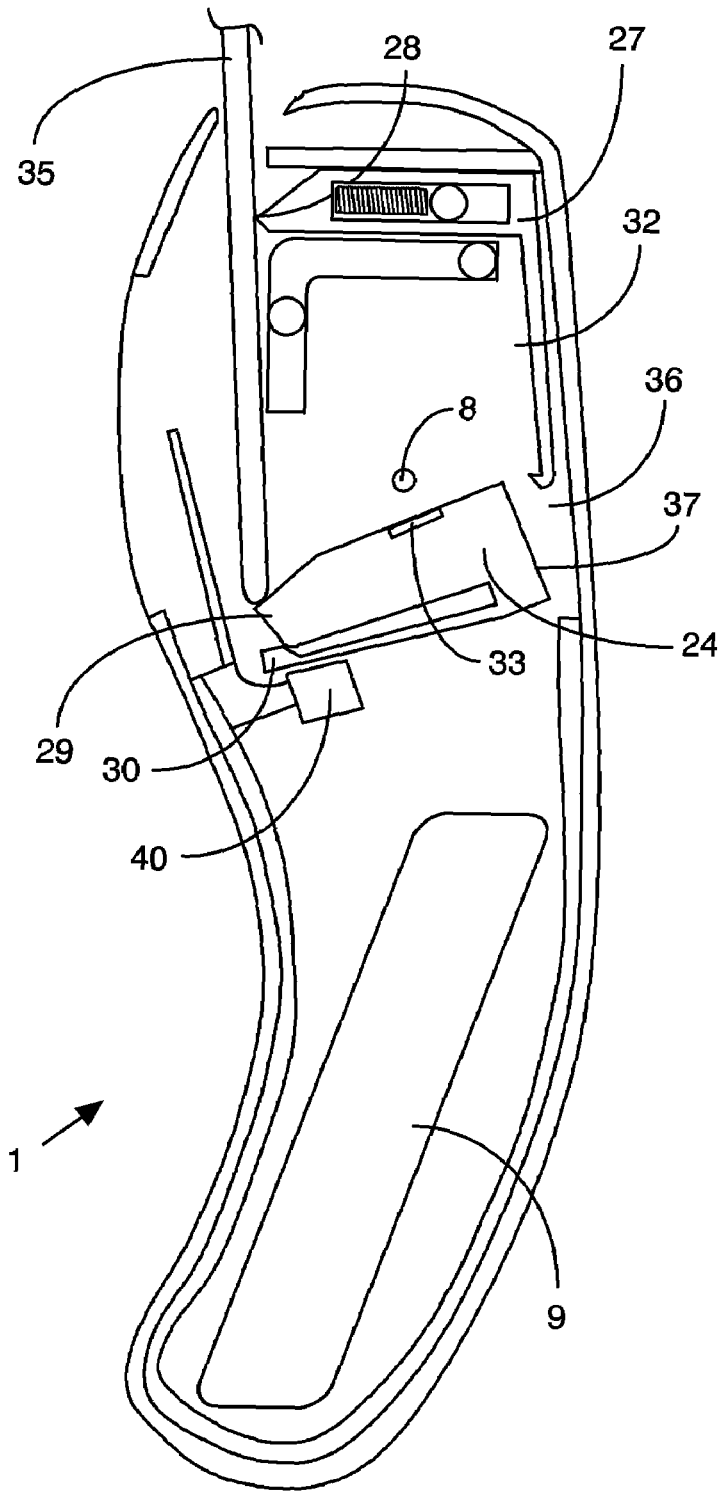
FIG. 13 illustrates another alternative embodiment in which a single straight detacher arm is used to actuate both the locking arm and the release arm.

FIG. 13 illustrates another alternative preferred embodiment in which a single detacher arm 35 is used to actuate both the locking arm 27 and the release arm 24. In this embodiment, detacher arm 35 forces locking arm 27 to the side upon entry into the detacher arm entry area 4. Detacher arm 35 has sufficient rigidity such that pressure exerted by locking armed 27 will not deflect it away from upper flange 29. In contrast, a conventional pick 11 will typically not have sufficient rigidity and will be deflected such that it does not contact upper flange 29.

Figure 14:
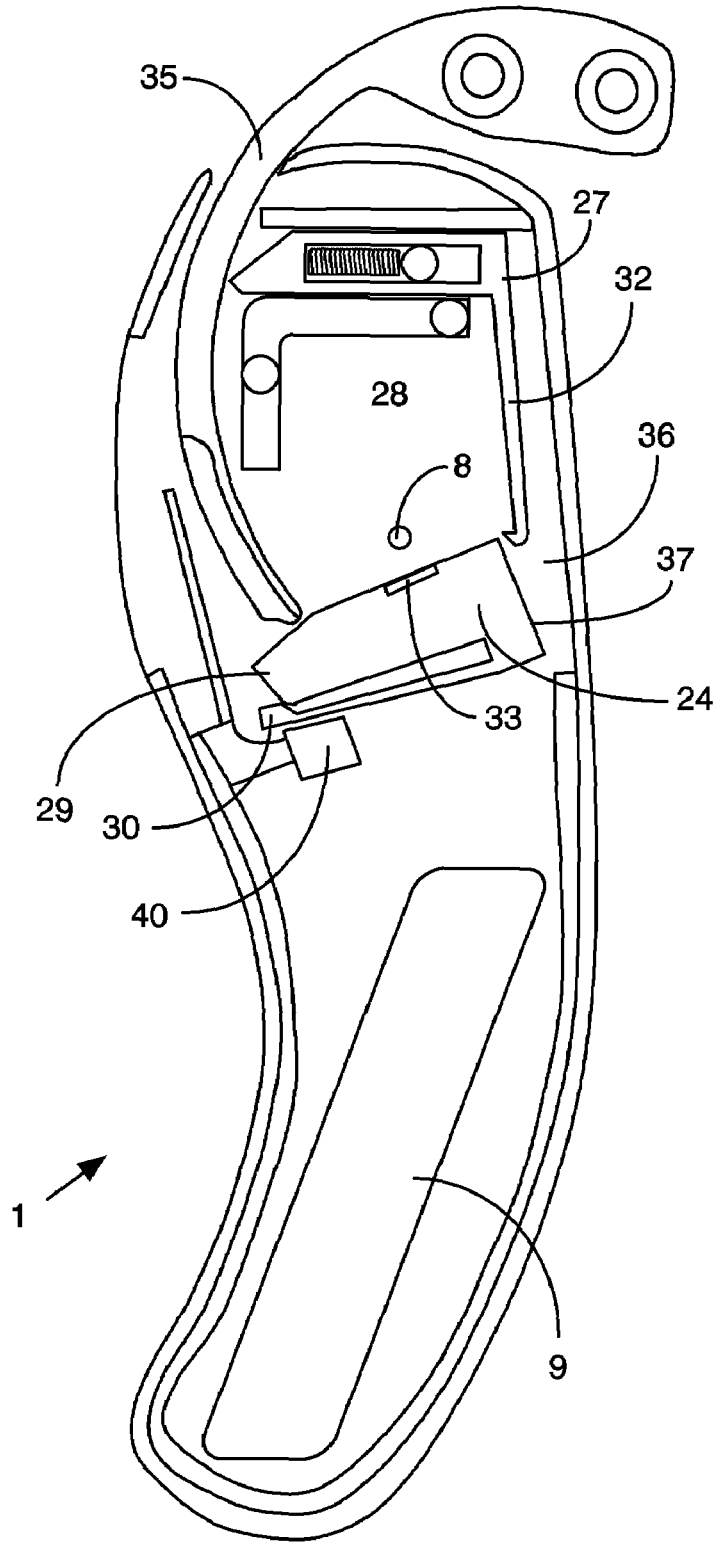
FIG. 14 illustrates another alternative embodiment in which a prior art curved detacher arm is used to actuate both the locking arm and the release arm.

FIG. 14 illustrates the alternative preferred embodiment of FIG. 13 in which a prior art curved detacher arm is used to actuate both the locking arm and the release arm.

While the invention has been described with respect to a preferred embodiment thereof, it will be understood by those skilled in the art that various changes in detail may be made therein without departing from the spirit, scope, and teaching of the invention. For example, the material used to construct the components of the anti-theft tag may be anything suitable for their purpose, the size and shape of the antitheft tag can vary can vary, etc. Accordingly, the invention herein disclosed is to be limited only as specified in the following claims.

I claim:

1. An anti-theft tag, further comprising:

a detacher arm chamber;

a detacher arm entry area providing an access path from the external surface of the anti-theft tag to the detacher arm chamber;

a clip, located in the detacher arm chamber, and sized to securely grasp a securing member pin;

a locking arm, the locking arm located within the detacher arm chamber and extending at least partially out of the detacher arm chamber and into the detacher arm entry path such that it obstructs entry to the detacher arm chamber, the locking arm further having a locked position, when a detacher arm is not engaging a door button, in which the locking arm prevents the clip from releasing the securing member pin, and an unlocked position, when a detacher arm is is engaging the door button, in which the locking arm does not prevent the clip from releasing the securing member pin a spring to hold the locking arm in the locked position when a detacher arm is not inserted into the anti-theft tag;

the door button having an open position in which the detacher arm engages the door button and pushes it into the detacher arm chamber, and a closed position which blocks entry to the detacher arm chamber, the door button held in the closed position by a spring when the detacher arm is not present, and moved to the open position under pressure from the detacher arm when the detacher arm engages the door button:

whereby the door button separates the detacher arm entry area from the detacher arm chamber until it is opened by the detacher arm.

2. An anti-theft tag, as in claim 1, wherein the door button is pivotable.

3. An anti-theft tag, as in claim 1, further comprising a dead-end cavity which provides a path for a pick which is guided away from the detacher arm chamber by the locking arm.

4. An anti-theft tag, as in claim 2, further comprising a dead-end cavity which provides a path for a pick which is guided away from the detacher arm chamber.

5. A method of preventing anti-theft tags from being picked, including the steps of:

isolating a lock in the anti-theft tag within a detacher arm chamber;

preventing access to the detacher arm chamber with a door which is normally in a closed position;

opening the door to the detacher arm chamber by applying pressure from the detacher arm;

opening the lock with the door, under pressure from the detacher arm;

using the door, when closed, to guide a pick away from the detacher arm chamber such that the pick slides past the detacher arm chamber;

whereby the door to the detacher arm chamber prevents a pick from entering the detacher arm chamber by guiding it away from the entrance to the detacher arm chamber.

6. A method, as in claim 5, including the additional step of pivotably attaching the door to the anti-theft tag.

7. A method, as in claim 6, including the additional step of using spring tension to maintain the door in the closed position.

8. A method, as in claim 7, including the additional step of overcoming the spring tension, under pressure from the detacher arm, to open the door when a detacher arm is inserted.

9. A method, as in claim 5, including the additional step of guiding a pick to a dead-end cavity when the pick is guided away from the detacher arm chamber by the door button.

10. A method of preventing anti-theft tags from being picked, including the steps of:

isolating a lock in the anti-theft tag within a detacher arm chamber;

preventing unauthorized access to the detacher arm chamber by sealing the entrance to the detacher arm chamber with a spring loaded door that is normally in a closed position such that an unauthorized pick slides past the entrance to the detacher arm chamber.

11. A method, as in claim 10, including the additional step of pivotably attaching the door to the anti-theft tag.

12. A method, as in claim 11, including the additional step of using spring tension to maintain the door in the closed position.

13. A method, as in claim 12, including the additional step of overcoming the spring tension to open the door when a detacher arm is inserted.

14. A method, as in claim 10, including the additional step of directing a pick to a dead-end cavity when the pick is guided away from the detacher arm chamber by the door button.

* * * * *